US007762827B2

(12) United States Patent
Liu

(10) Patent No.: US 7,762,827 B2
(45) Date of Patent: Jul. 27, 2010

(54) CARD ASSEMBLY WITH A HINGED COVER INCLUDING A TORSION SPRING

(75) Inventor: Zhi-Yang Liu, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/509,965

(22) Filed: Jul. 27, 2009

(65) Prior Publication Data

US 2010/0112838 A1 May 6, 2010

(30) Foreign Application Priority Data

Oct. 31, 2008 (CN) ..... 2008 1 0305353

(51) Int. Cl.
*H01R 13/62* (2006.01)

(52) U.S. Cl. ..... 439/331

(58) Field of Classification Search ..... 439/331, 439/133, 367, 259, 327; 361/816; 174/35 R; 348/375

See application file for complete search history.

(56) References Cited

U.S. PATENT DOCUMENTS

| | | | | |
|---|---|---|---|---|
| 5,337,220 | A * | 8/1994 | Granitz | 361/816 |
| 5,781,232 | A * | 7/1998 | Ejima | 348/231.7 |
| 5,987,122 | A * | 11/1999 | Daffara et al. | 379/433.13 |
| 6,234,820 | B1 * | 5/2001 | Perino et al. | 439/326 |
| 6,270,369 | B1 * | 8/2001 | Kato et al. | 439/326 |
| 6,493,033 | B1 * | 12/2002 | Glogan et al. | 348/375 |
| 6,890,203 | B2 * | 5/2005 | Matsunaga et al. | 439/331 |
| 2009/0234034 | A1 * | 9/2009 | Blanco | 521/48 |

* cited by examiner

*Primary Examiner*—Chandrika Prasad
(74) *Attorney, Agent, or Firm*—Steven M. Reiss

(57) ABSTRACT

A card socket assembly includes a main body, a hinge assembly; a cover rotatably assembled on the main body by the hinge assembly; and a release button releasably latching the cover to the main body. When the release button is detached from the cover, the cover is rotated relative to the main body by the hinge assembly.

19 Claims, 6 Drawing Sheets

CARD ASSEMBLY WITH A HINGED COVER INCLUDING A TORSION SPRING

BACKGROUND

1. Technical Field

The present disclosure relates to card socket assemblies and, particularly, to a card socket assembly used in a portable electronic device, e.g., mobile phones, personal digital assistants (PDAs), palm computers etc.

2. Description of Related Art

With the development of wireless technology, portable electronic devices are becoming widely used and multifunctional. A portable electronic device usually includes several data cards, e.g., a subscriber identity module (SIM) card used to store personal information and a secure digital memory (SD) card used to store audio data and video data. Thus, card socket assemblies are required for users to easily secure and remove these data cards.

A typical card socket assembly includes a card slot defined in a housing of a portable electronic device. The card socket assembly further includes a securing means used to secure a data card within the card slot.

However, to remove the data card from the card slot, a user has to apply a quite large force on the data card against a securing force of the securing means. Thus, it is easy to damage the data card and the securing means.

Therefore, there is a room for improvement within the art.

BRIEF DESCRIPTION OF THE DRAWINGS

Many aspects of a card socket assembly can be better understood with reference to the following drawings. The components in the drawings are not necessarily to scale, the emphasis instead being placed upon clearly illustrating the principles of the present card socket assembly. Moreover, in the drawings, like reference numerals designate corresponding parts throughout the several views.

DETAILED DESCRIPTION OF THE EMBODIMENTS

Figure 1:
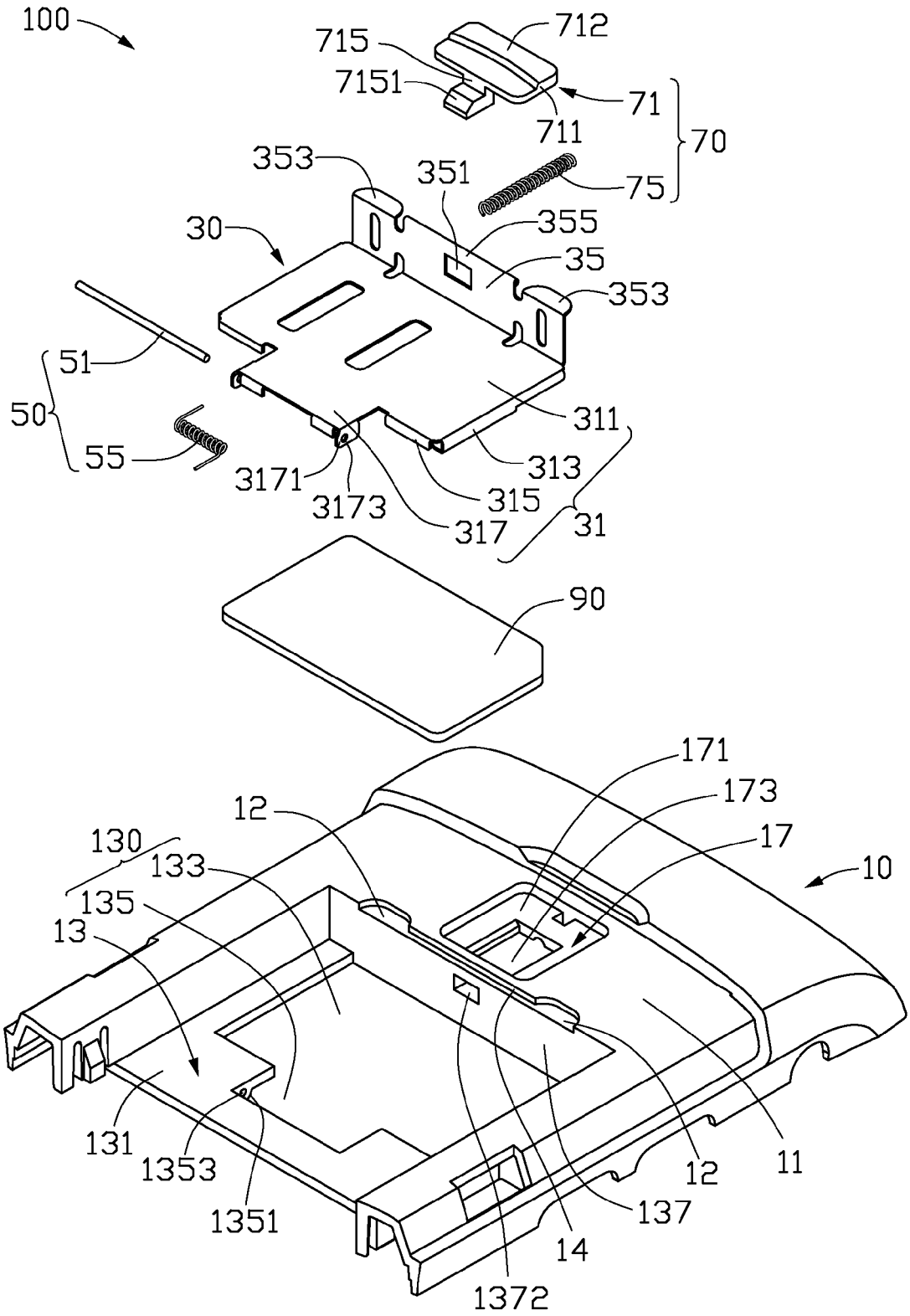
FIG. 1 is an assembled, perspective view of a card socket assembly in accordance with an exemplary embodiment.
Figure 2:
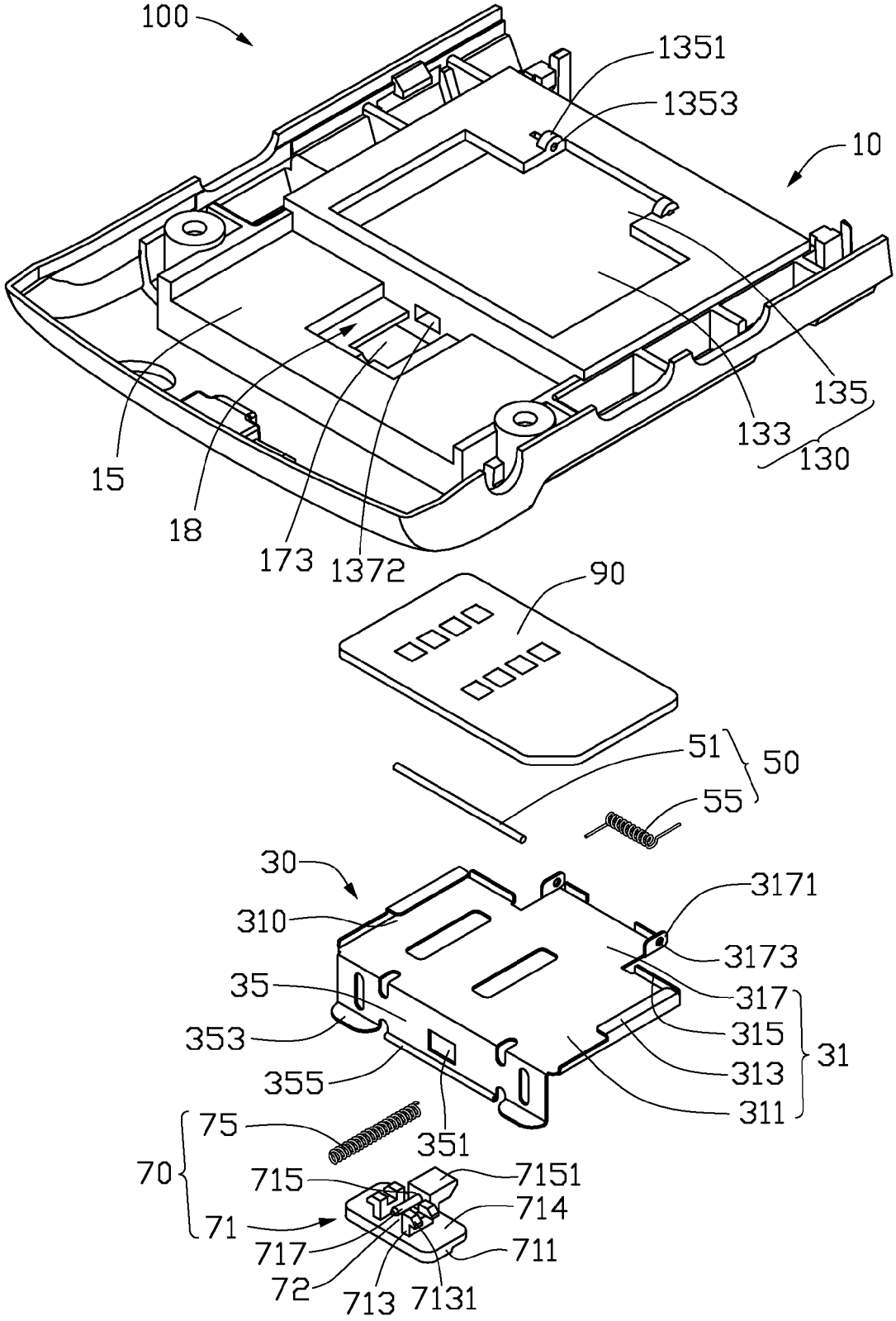
FIG. 2 is similar to FIG. 1, but viewed from another angle.

FIGS. 1 and 2 show an exemplary card socket assembly 100 used in portable electronic devices, such as mobile phone terminals, digital cameras, and others. The card socket assembly 100 is used to secure a data card 90. The card socket assembly 100 includes a main body 10, a cover 30, a hinge assembly 50, and a release button 70.

The main body 10 includes a first wall 11 and an opposite second wall 15. The first wall 11 defines a receiving portion 13, an assembling chamber 17 adjacent to the receiving portion 13, two latching portions 12, and a groove 14. The receiving portion 13 includes a bottom wall 131 and a sidewall 137 perpendicularly extending from the bottom wall 131. The bottom wall 131 includes a cover receiving portion 130 and two protrusions 1351. The bottom wall 131 defines a first opening 133 adjacent to the sidewall 137 and a second opening 135 oriented away from the sidewall 137. The first opening 133 is configured for accommodating the data card 90. The second opening 135 communicates with the first opening 133. The protrusions 1351 are respectively positioned at two opposite ends of the second opening 135. The protrusions 1351 respectively define a latching hole 1353 facing each other. The sidewall 137 defines a through hole 1372 in a middle thereof. The through hole 1372 communicates with the assembling chamber 17. The latching portions 12 are defined in the first wall 11 adjacent to the sidewall 137 and are defined at two sides of the assembling chamber 17. The groove 14 is defined in the first wall 11 adjacent to the sidewall 137 and communicates with the latching portions 12. The assembling chamber 17 includes a bottom wall 171 defining a through notch 173. The second wall 15 defines a receiving slot 18 corresponding to the assembling chamber 17. The receiving slot 18 communicates with the assembling chamber 17 by the through notch 173.

The cover 30 may be made by injection molding or impact molding. The cover 30 is rotatably assembled on the bottom wall 131 and covers the first opening 133 and the second opening 135. The cover 30 includes a top cover 31 and a matching wall 35 perpendicularly bent away from the top cover 31. The top cover 31 includes a cover portion 311, two latching walls 313, two resisting walls 315, and a connecting portion 317. The latching walls 313 are L-shaped bent from two opposite ends of the cover portion 311. The resisting walls 315 are respectively bent away from the cover portion 311 facing to the matching wall 35. The resisting walls 315, the cover portion 311, and the latching walls 313 cooperatively enclose a chamber 310 configured for receiving the data card 90. The connecting portion 317 extends from an end of the cover portion 311 opposite to the matching wall 35 and is positioned between the resisting walls 315. The connecting portion 317 includes two arms 3171 perpendicularly bent away from two opposite sides thereof. Each arm 3171 defines a shaft hole 3173 therein. The matching wall 35 defines an aperture 351 in a middle thereof. The matching wall 35 includes two latching arms 353 and an extending portion 355 bent from a free end thereof. The latching arms 353 respectively extend from two sides of the free end. The extending portion 355 extends from a middle of the free end and between the latching arms 353.

The hinge assembly 50 includes a shaft 51 and a torsion spring 55. The hinge assembly 50 is configured for rotatably connecting the cover 30 to the main body 10.

The release button 70 includes a releasing portion 71 and a resilient part 75. The releasing portion 71 is slidable in the assembling chamber 17 for latching or releasing the cover 30. The releasing portion 71 includes a plate 711, two latching blocks 713 positioned on the plate 711, a release block 715, and a post 717. The latching blocks 713 are symmetrically positioned on a surface of the plate 711. A free end of each of latching blocks 713 perpendicularly extends two clasps 7131 spaced with each other. A gap 72 is formed between the latching blocks 713. The release block 715 is positioned on a periphery edge of the plate 711. A free end of the release block 715 perpendicularly extends a hook 7151 away from the latching blocks 713. The release block 715 aligns with the gap 72. The post 717 is positioned on the release block 715 and between the latching blocks 713. The resilient part 75 is a helical spring, coils around the post 717, and resists the assembling chamber 17.

Figure 3:
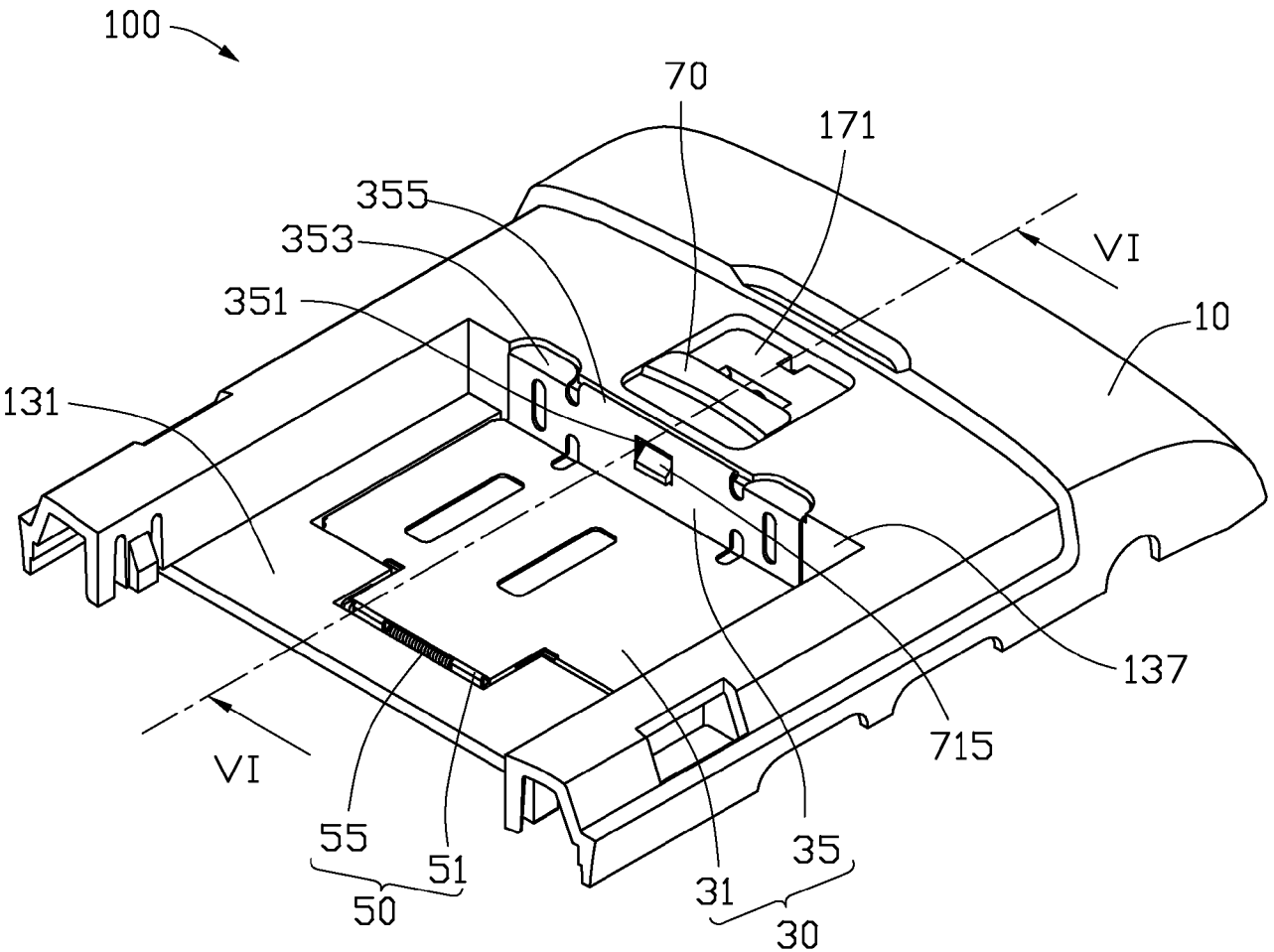
FIG. 3 is a perspective view of a cover latched on a main body of the card socket assembly and in a closed state.
Figure 4:
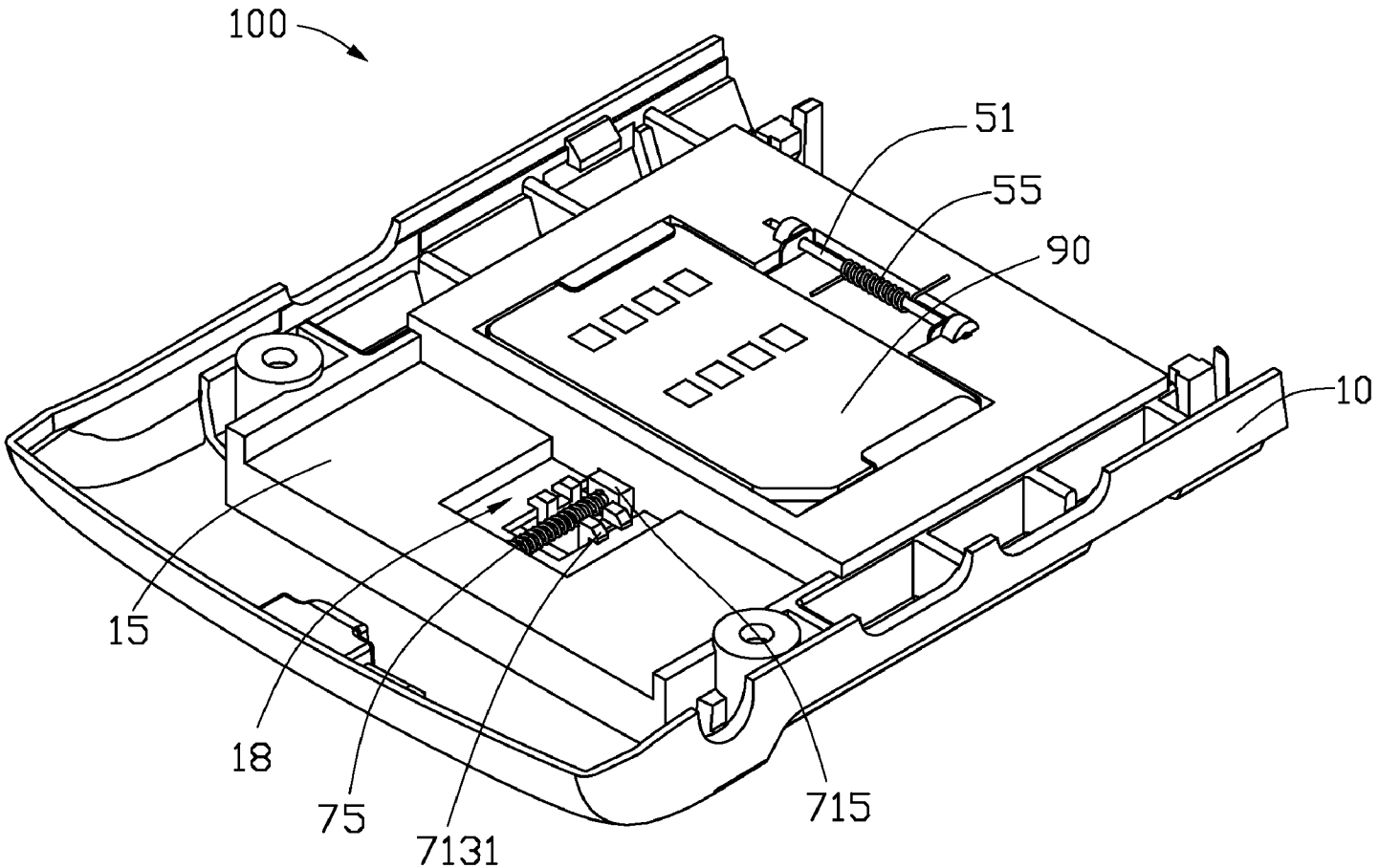
FIG. 4 is similar to FIG. 3, but viewed from another angle.

Referring to FIG. 3 and FIG. 4, in assembly, the release button 70 is placed in the assembling chamber 17. The resilient part 75 coils around the post 717. The release block 715 passes through the through hole 1372 and extends from the sidewall 137. The latching blocks 713 latch in the through notch 173. A free end of each of the latching blocks 713 is received in the receiving slot 18. The resilient part 75 slidably resists the wall portion of the assembling chamber 17. The connecting portion 317 is inserted in the second opening 135 and each shaft hole 3173 aligns with the latching hole 1353. The shaft 51 is inserted into each latching hole 1353 and the shaft hole 3173. The torsion spring 55 coils around the shaft 51 between the arms 3171. The torsion spring 55 resists the cover 30 and the main body 10. Thus, the cover 30 is rotatably assembled on the main body 10 and covers the cover receiving portion 130.

Figure 5:
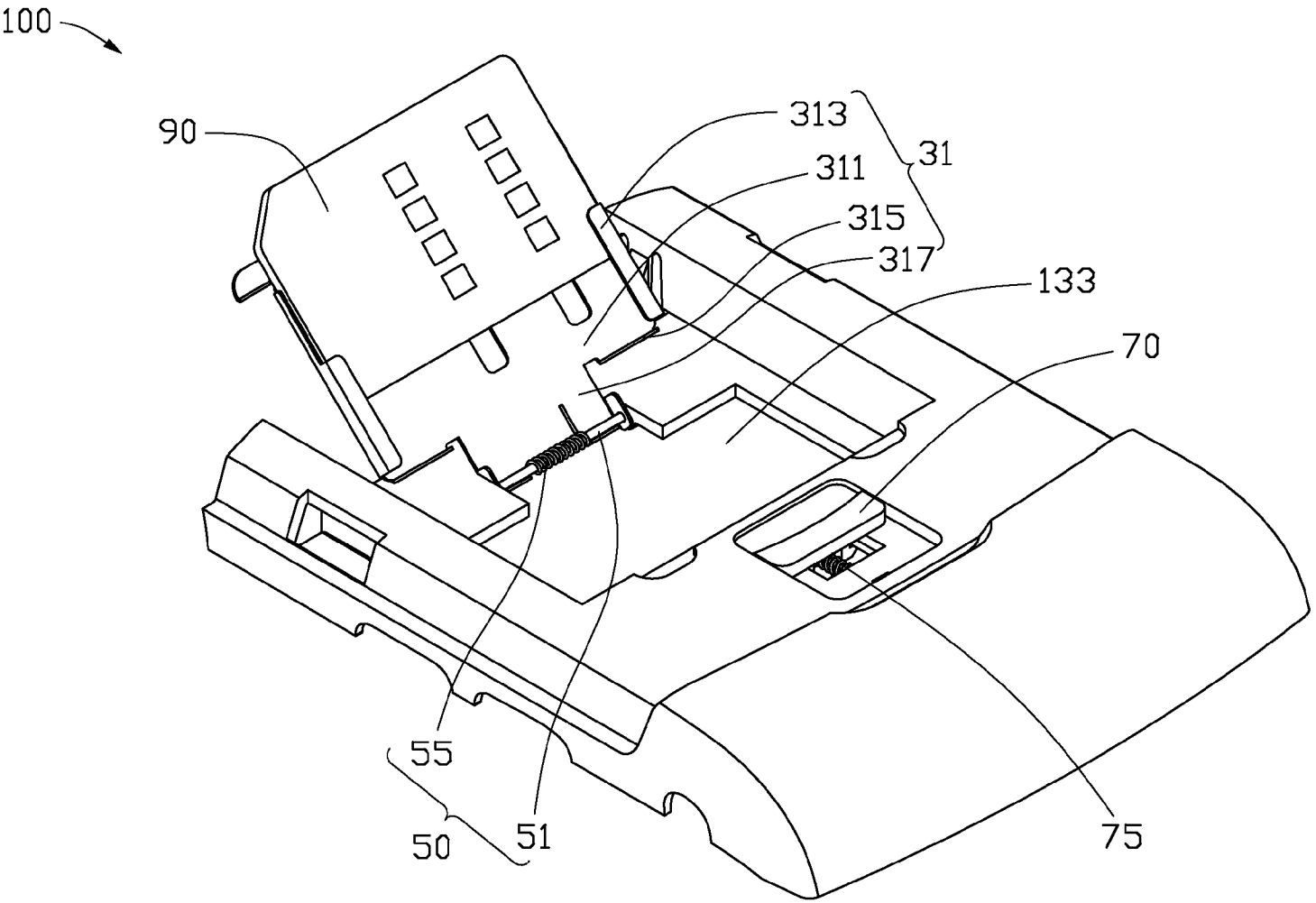
FIG. 5 is a perspective view of the cover latched on the main body but in an open state.
Figure 6:
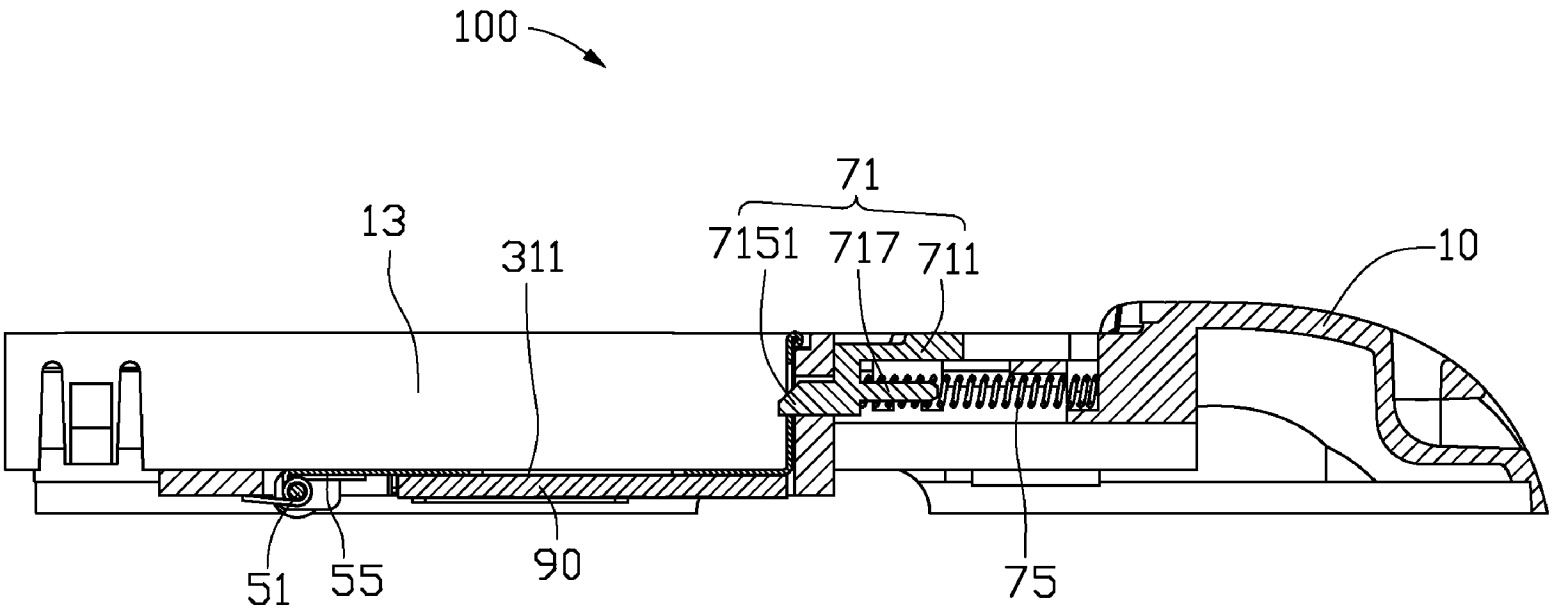
FIG. 6 is a cross-sectional view taken along line VI-VI of FIG. 3.

Referring to FIG. 5 and FIG. 6, when the cover 30 is closed, the data card 90 is received in the chamber 310. The matching wall 35 resists the sidewall 137. The release block 715 latches in the aperture 351 of the matching wall 35. The latching arms 353 respectively latch to the latching portions 12. The extending portion 355 latches in the groove 14.

When the data card 90 needs to be removed from the main body 10, the release button 70 is pushed away from the sidewall 137. Thus, the matching wall 35 is detached from the release block 715. The torsion spring 55 drives the cover 30 rotating around the shaft 51, thereby, the cover 30 being opened relative to the main body 10. Thus, the data card 90 is taken out from the cover 30.

It is to be understood, however, that even through numerous characteristics and advantages of the present disclosure have been set forth in the foregoing description, together with details of the structure and function of exemplary embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A card socket assembly, comprising:

a main body;

a hinge assembly comprising a torsion spring;

a cover rotatably mounted on the main body by the hinge assembly, and comprising a chamber configured for receiving a data card; and a release button slidably assembled in the main body, and latching to the cover;

wherein when the release button is detached from the cover, the cover is rotated from the main body by the torsion spring.

2. The card socket assembly as claimed in claim 1, wherein the main body comprises a receiving portion defining a cover receiving portion, and an assembling chamber adjacent to the cover receiving portion, the cover rotatably assembled on the receiving portion and covers the cover receiving portion, the release button comprises a plate and two latching blocks positioned thereon, the latching blocks latch in the assembling chamber.

3. The card socket assembly as claimed in claim 2, wherein the assembling chamber defines a through hole communicating with the assembling chamber, the release button further comprises a release block positioned on the plate corresponding to the through hole, the release block latches to the cover by the through hole.

4. The card socket assembly as claimed in claim 3, wherein the cover comprises a top cover and a matching wall perpendicularly bent away from the top cover, the matching wall defines an aperture corresponding to the through hole, the release block latches in the aperture.

5. The card socket assembly as claimed in claim 4, wherein the release button further comprises a post positioned on the release block, and a resilient part coils around the post and latches to the assembling chamber, the release button is slidably assembled in the assembling chamber.

6. The card socket assembly as claimed in claim 4, wherein the main body further comprises two latching portions adjacent to the cover receiving portion, and a groove communicating with the latching portions, the matching wall comprises two latching arms bent thereof, and an extending portion bent thereof, the latching arms latch to the latching portions, the extending portion latching to the groove.

7. The card socket assembly as claimed in claim 6, wherein the top cover comprises a cover portion, two latching walls and two resisting walls, each of the latching walls is L-shaped bent from two opposite ends of the cover portion, the resisting walls are respectively bent away from the cover portion facing to the matching wall, the resisting walls, the cover portion and the latching walls cooperatively enclose the chamber.

8. The card socket assembly as claimed in claim 7, wherein the top cover further comprises a connecting portion extending from an end of the cover portion opposite to the matching wall, the connecting portion includes two arms perpendicularly bent away from two opposite sides thereof, the arms respectively define a shaft hole therein, the hinge assembly further comprises a shaft passing through the shaft hole.

9. The card socket assembly as claimed in claim 8, wherein the receiving portion comprises two protrusions positioned thereon, the shaft is secured on the protrusions.

10. The card socket assembly as claimed in claim 1, wherein the cover is made by injection molding or impact molding.

11. A card socket assembly, comprising:

a main body;

a hinge assembly;

a cover rotatably assembled on the main body by the hinge assembly; and a release button releasably latching the cover to the main body;

wherein when the release button is detached from the cover, the cover is rotated relative to the main body by the hinge assembly wherein the hinge assembly includes a shaft and a torsion spring and the cover has a chamber to receive a data card.

12. The card socket assembly as claimed in claim 11, wherein the main body comprises a receiving portion defining a cover receiving portion, and an assembling chamber adjacent to the cover receiving portion, the cover rotatably assembled on the receiving portion and covers the cover receiving portion, the release button comprises a plate and two latching blocks positioned thereon, the latching blocks latch in the assembling chamber.

13. The card socket assembly as claimed in claim 12, wherein the assembling chamber defines a through hole communicating with the assembling chamber, the release button further comprises a release block positioned on the plate corresponding to the through hole, the release block latches to the cover by the through hole.

14. The card socket assembly as claimed in claim 13, wherein the cover comprises a top cover and a matching wall perpendicularly bent away from the top cover, the matching wall defines an aperture corresponding to the through hole, the release block latches in the aperture.

15. The card socket assembly as claimed in claim 14, wherein the release button further comprises a post positioned on the release block, and a resilient part coils around the post and latches to the assembling chamber, the release button is slidably assembled in the assembling chamber.

16. The card socket assembly as claimed in claim 14, wherein the main body further comprises two latching portions adjacent to the cover receiving portion, and a groove communicating with the latching portions, the matching wall comprises two latching arms bent thereof, and an extending portion bent thereof, the latching arms latch to the latching portions, the extending portion latching to the groove.

17. The card socket assembly as claimed in claim 16, wherein the top cover comprises a cover portion, two latching walls and two resisting walls, each of the latching walls is L-shaped bent from two opposite ends of the cover portion, the resisting walls are respectively bent away from the cover portion facing to the matching wall, the resisting walls, the cover portion and the latching walls cooperatively enclose the chamber.

18. The card socket assembly as claimed in claim 17, wherein the top cover further comprises a connecting portion extending from an end of the cover portion opposite to the matching wall, the connecting portion includes two arms perpendicularly bent away from two opposite sides thereof, the arms respectively define a shaft hole therein, the shaft passes through the shaft hole.

19. The card socket assembly as claimed in claim 18, wherein the receiving portion comprises two protrusions positioned thereon, the shaft is secured on the protrusions.

* * * * *